US005120383A

United States Patent [19]

Takei et al.

[11] Patent Number: 5,120,383

[45] Date of Patent: Jun. 9, 1992

[54] THERMAL TRANSFER INK SHEET AND METHOD OF PRINTING

[75] Inventors: Katsumori Takei; Hitoshi Fukushima; Kohei Iwamoto; Hiroto Nakamura, all of Suwa, Japan

[73] Assignee: Seiko Epson Corporation, Tokyo, Japan

[21] Appl. No.: 401,516

[22] Filed: Aug. 30, 1989

Related U.S. Application Data

[63] Continuation of Ser. No. 137,130. Dec. 23, 1987, abandoned, which is a continuation of Ser. No. 851,759, Apr. 14, 1986, abandoned.

[30] Foreign Application Priority Data

Dec. 29, 1986 [JP] Japan ..... 61-310236
Dec. 29, 1986 [JP] Japan ..... 61-310237

[51] Int. Cl.[5] ..... B41M 5/26

[52] U.S. Cl. ..... 156/240; 156/277; 427/146; 427/261; 428/195; 428/206; 428/327; 428/336; 428/484; 428/488.1; 428/488.4; 428/913; 428/914

[58] Field of Search ..... 428/195, 207, 484, 488.1, 428/488.4, 913, 914, 323, 327, 335, 336, 206; 156/239, 240, 277; 427/146, 256, 258, 261

[56] References Cited

U.S. PATENT DOCUMENTS 4,880,324 11/1989 Sato et al. ..... 428/195

FOREIGN PATENT DOCUMENTS 81185 5/1984 Japan ..... 428/488.4
1116591 6/1986 Japan ..... 428/488.4

*Primary Examiner*—Pamela R. Schwartz
*Attorney, Agent, or Firm*—Blum Kaplan

[57] ABSTRACT

A thermal transfer ink sheet including a heat resistant support film, a first fusible ink layer disposed on the support film, an interlayer which will support the first ink layer in uniform layer condition during thermal printing and will still separate cleanly from the non-printed portion on the first ink layer and a second fusible ink layer on the interlayer. Several embodiments of the interlayer will maintain the first ink layer in uniform layer condition during thermal printing. The interlayer can be formed of: a material with a low melting point whose viscosity does not decrease substantially when its temperature is increased; a thin film of thermosetting resin; and a layer of material formed of minute grains or domains smaller than a pixel which will form a pixel sized layer support during thermal printing. To print with the thermal transfer ink sheet constructed in accordance with the invention, the exposed surface of the support film is selectively heated to transfer the interlayer and both fusible ink layers to the recording medium after the support film is stripped away. All the layers separate cleanly and the interlayer supports the printed portion of the first ink layer in layer condition to yield a uniform visible printed surface.

37 Claims, 3 Drawing Sheets

THERMAL TRANSFER INK SHEET AND METHOD OF PRINTING

This is a continuation of application Ser. No. 07/137,130 filed Dec. 23, 1987 now abandoned, which is a continuation of application Ser. No. 6/851,759, filed Apr. 14, 1986 now abandoned.

BACKGROUND OF THE INVENTION

This invention relates generally to a thermal transfer ink sheet and a method of printing and, more specifically to ink sheets including a fusible ink and a heat resistant film loaded with the ink, suitable for transferring images onto recording media with rough surfaces.

Conventional methods of thermal transfer printing utilize a ribbon shaped or web shaped ink sheet or support made from a heat resistant film coated with fusible ink. A thermal transfer recording apparatus prints by heating specific portions of the ink sheet to melt the fusible ink and transfer the ink at specific portions to the recording medium. The printing sheet is stripped off the recording medium leaving the previously softened portions of ink on the recording medium in the form of dots of ink called pixels.

FIGS. 8A and 8B illustrate conventional thermal printing. Using an ink transfer film 80 including a heat resistant film c having a fusible ink layer b disposed thereon, ink transfer film 80 is interposed between a print head p and a recording medium or paper s. Print head p is heated electrically where printing is desired. Heat passes through heat resistant film c into ink layer b to soften the ink directly between print head p and paper s. Ink sheet 80 is then removed in the direction of arrow e and printed portions b' remain affixed to the surface of paper s.

If paper s is rough, it will have a plurality of convex hills d which contact ink layer b during printing and a plurality of concave valleys g therebetween which do not contact ink layer b. Heat from print head p is conducted from ink layer b at hills d of paper s where ink layer b contacts paper s. Heat is not conducted to concave valleys of paper s. Accordingly, ink will not flow into valleys q and flows towards the heated convex portions d on the surface of paper s which are higher in temperature.

When ink sheet c is removed from recording paper s, as shown in FIG. 8B, recording paper s has non-uniform clumps of ink on convex hills d and voids over concave valleys g. The voids lead to lower optical density of the printed image. The non-uniform printed surface causes irregular refraction of light. To correct this problem, prior art methods have substituted inks with low fluidity to prevent ink from flowing onto the raised portions of rough surfaced paper. Such inks require more thermal energy to accomplish the transfer process. Further, these less fluid inks do not adhere to the recording paper as well as the more fluid inks. Thus, such attempts have not been fully satisfactory.

Accordingly, it is desirable to provide improved thermal transfer ink sheets which overcome the deficiencies of the prior art by providing an ink sheet capable of forming uniform images with high dot concentration on rough surfaces recording media while using a low level of thermal printing energy. Similarly, it is desirable to print high density uniform images with an improved thermal transfer method.

SUMMARY OF THE INVENTION

Generally speaking, in accordance with the invention, an improved thermal transfer ink sheet is provided. The thermal transfer ink sheet constructed in accordance with the invention includes a heat resistant support film, a first fusible ink layer disposed on the support film, an interlayer which will support the first ink layer in uniform layer condition during thermal printing and will still separate cleanly from the non-printed portion on the first ink layer and a second fusible ink layer on the interlayer. Several embodiments of the interlayer will maintain the first ink layer in uniform layer condition during thermal printing. The interlayer can be formed of: a material with a low melting point whose viscosity does not decrease substantially when its temperature is increased; a thin film of thermosetting resin; and a layer of material formed of minute grains or domains smaller than a pixel which will form a pixel sized layer support during thermal printing.

To print with the thermal transfer ink sheet constructed in accordance with the invention, the exposed surface of the support film is selectively heated to transfer the interlayer and both fusible ink layers to the recording medium after the support film is stripped away. All the layers separate cleanly and the interlayer supports the printed portion of the first ink layer in layer condition to yield a uniform visible printed surface.

Accordingly, it is an object of the invention to provide an improved thermal transfer ink sheet.

Another object of the invention is to provide a thermal transfer ink sheet capable of forming uniform images of high pixel concentration on a recording medium having a rough surface.

A further object of the invention is to provide a thermal ink transfer sheet utilizing low thermal printing energy.

Yet another object of the invention is to provide a method for high resolution, clear transfer-printing with a thermal transfer ink sheet.

Still other objects and advantages of the invention will in part be obvious and will in part be apparent from the specification and drawings.

The invention accordingly comprises the several steps and the relation of one or more of such steps with respect to each of the others, and the article possessing the features, properties, and the relation of elements, which are exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
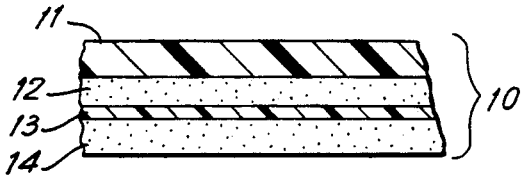
FIG. 1 is a sectional view of a thermal transfer sheet constructed in accordance with the invention.

A thermal transfer ink sheet ted in accordance with the invention is shown generally as 10 in FIG. 1. Ink sheet 10 includes a heat resistant support film 11, a first ink layer 12 of wax and a pigment which will be visible after printing disposed on support film 11, an interlayer 13 of a thermoplastic resin on first ink layer 12 and a second ink layer 14 disposed on interlayer 13.

Figure 2A:
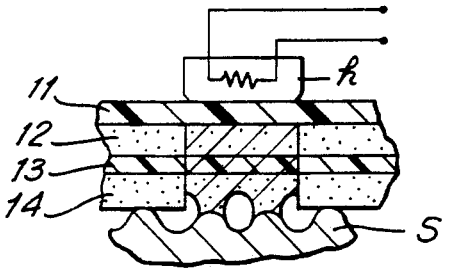
FIGS. 2A and 2B are setional views illustrating the use of the thermal transfer ink sheet of FIG. 1 to print images on rough recording paper having a rough surface.
Figure 2B:
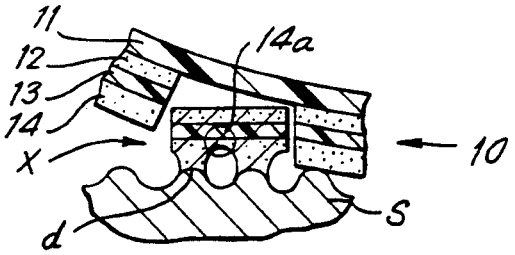

Ink transfer printing utilizing ink sheet 10 is performed as illustrated in FIGS. 2A and 2B. Ink sheet 1 is transported between a print head h and the surface of a recording medium or paper s. Print head h selectively heats discrete portions of ink transfer sheet 10 corresponding to points where a pixels x is desired on recording paper s. This heating causes second ink layer 14 to soften and melt and adhere pixel x to the surface of recording paper s.

Interlayer 13 maintains its layer structure and supports first ink layer 12 on its upper surface. First ink layer 12 remains in a uniform condition even though first ink layer 12 is melted during printing and is cooled unevenly by recording paper s. In this manner, a uniform surface of ink can be applied to a recording medium even if the recording medium has a rough surface. Printing sheet 11 is then stripped from recording paper s as shown in FIG. 2B. Dots of ink or pixel x including all three layers which are heated during printing, remain affixed to recording paper s. In the regions where ink sheet 11 is not heated, second ink layer 14 does not melt and adhere to recording paper s and all three layers are removed with support film 11.

Heat resistant support film 11 is made from materials selected to provide proper thermal-mechanical strength and heat conductivity such as condenser paper and heat resistant polymers of polyethylene terephthalate (PET), polyether sulfone (PES), polyetherether ketone (PEEK), polyphenylene sulfide (PPS), polymide, polyamideimide and polycarbonate. Support film 11 is generally made from a 1 to 12 μm thick layer of heat resistant polymer.

Figure 3:
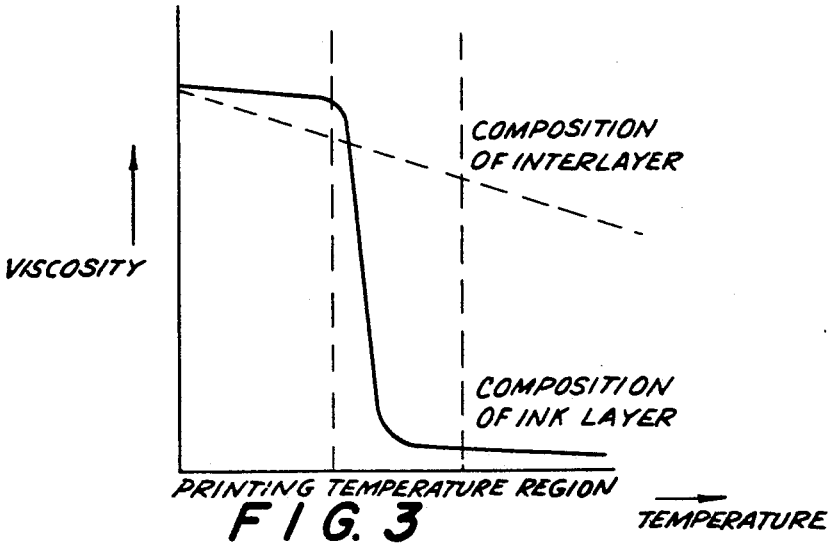
FIG. 3 is a graph illustrating variation in viscosity of an ink layer and an interlayer with temperature.

When ink sheet 10 is stripped away from paper s, the division between the printed portion which adheres to recording paper s and the non-printed portion which remains affixed to support film 11 must be clean and sharp. Bleeding and blocking which can occur before ink sheet 10 is used for printing, must be prevented. Further, printing with relatively low thermal energy while obtaining the required optical density must be insured. In order to achieve these objectives, first ink layer 12 is formed by mixing a dye or pigment in a binder. The binder preferably is a wax, such as natural wax, petroleum wax, synthetic wax or the like and at least one member selected from the group which includes fatty amide, fatty ester, methyl cellulose, carboxyl methyl cellulose, styrene-butadiene copolymer, methylmethacrylate resin, silicone resin, polyethylene, styrene-acryl copolymer, acrylic resins, polystyrenes and mixtures thereof. First ink layer 12 should include at least about 50 wt % wax and from about 1 to 50 wt % dye or pigment. The composition is varied to change the melting viscosity to improve pixel sharpness as shown in FIG. 3. Clean breaking points between printed and non-printed portions are achieved by using materials with viscosities that will decrease dramatically over slight temperature increments. Preferably, the melting point of first ink layer 12 is between about 40° to 200° C. and the thickness from about 1 to 5 μm.

Interlayer 13 functions to support first ink layer 12 in a uniform layer and prevent first ink layer 12 from melting and flowing in the direction of recording paper s during printing. Interlayer 13 remains essentially uniform and prevents flowing of ink during heating (see, FIG. 3) and improves the sharpness of the cut between interlayer 13 and adjacent non-recorded portions.

These conditions are satisfied by selecting components of interlayer 13 which are the same thermoplastic materials used in first ink layer 12 as a main component. However, about 50 wt % or less wax should be used to prevent ink flowing while heating. An inorganic material, such as calcium carbonate, titanium oxide and carbon black are added to improve pixel sharpness. Preferably, interlayer 13 is between about 0.1 to 5 μm thick and has a softening temperature between about 50° to 150° C.

Interlayer 13 can be formed in a variety of ways. Interlayer 13 can be a material with a low melting point in which viscosity does not vary appreciably as temperature changes during thermal printing. It can be made from a thin film including thermosetting resins. The interlayer may be formed of individual plate-like domains separated by gaps or of particles or grains of thermoplastic material. In each embodiment, the interlayer maintains the uniform layer structure of the first ink layer when the first ink layer melts during thermal printing.

Second ink layer 14 is the uppermost of first ink layer 12 and interlayer 13 and bonds these layers to recording paper s. To do this, second ink layer 14 may be formed of the same materials as first ink layer 12, including thermoplastic materials, such as the waxes and polymers and ink materials. In order to improve the sharpness of the separation between ink pixel x and adjacent non-recorded ink layer 14, to prevent blocking and bleeding before printing and to reduce the energy required for printing, it is desirable to set the melting point of second ink layer 14 between about 50° and 150° C. and the thickness between about 2 and 10 μm. When the binder portion of second ink layer 14 includes at least about 40 wt % waxes the adhesion of second ink layer 14 to paper s improves.

It is not always necessary to include pigments or colorants in second ink layer 14. If colorants are not added, corrections are made easily by scraping first ink layer 12 and interlayer 13 from recording paper s after printing. If colorants are present in second ink layer 14, thermal printings are indelible.

Printing on rough recording paper s with ink sheet 10 will be described in connection with FIGS. 2A and 2B. During printing, ink sheet 10 is heated by thermal head h in response to recording signals. Ink in the recording portion of second ink layer 14 melts and flows onto recording paper s and permeates into connecting fibers at contacting point d. Since the main ingredient of interlayer 13 is thermoplastic resins in which viscosity is not significantly lowered on heating, the layer structure is maintained in a uniform manner. The thickness of interlayer 13 remains substantially uniform in recorded portion or pixel x and does not flow, as shown in FIG. 2A.

When support film 11 is stripped from the recording paper s, pixel x of first ink layer 12 is transferred to recording paper s with interlayer 13 maintaining the uniform thickness of first ink layer 12. Even though ink 14*a* in a region not affixed to paper s becomes thin as ink flows towards convex hills d of recording paper s, interlayer 13 supports first ink layer 12 and presents a uniform film of first ink layer 12 for the region of pixel x.

Interlayer 13 can be formed from a thin film of thermoplastic resins and can include thermosetting resins. In this embodiment, first and second ink layers 12 and 14 and supporting layer 11 are formed of the materials described above. Examples of suitable thermoplastic resins include phenol resin, melanin resin, urea resin, unsaturated polyester resin, epoxy resin, polyimide, silicone resin, alkyd resin, urethane resin, casein resin and the like in an extremely thin film between about 0.1 to 5 μm thick. Interlayer 13 supports first ink layer 12 in a uniform condition during printing and separates cleanly from the non-recorded portion when support film 11 was stripped away from pixel x due to the weakness of interlayer 13. As a result, first ink layer 12 melts, but is maintained as a uniform visible ink layer due to interlayer 13. In accordance with this embodiment, interlayer 13 maintains its layered condition without substantial softening during heating. This prevents ink in the recorded portion of first ink layer 12 which was melted from flowing and maintains ink layer 12 as film of uniform thickness. This is due to the characteristic shown in FIG. 2A.

When supporting film 11 is stripped away from paper s after printing, ink in each recorded portion of first and second ink layer 12 and 14 separate from ink in the non-recorded portions which remain solid. Interlayer 13 is also separated from the non-recorded portion and the recorded portion is transferred onto recording paper s which maintains the uniform thickness of first ink layer 12. Ink portion 14*a* at an ink region not connected to paper s forms a thin film due to ink flowing to convex hills d on paper s and is supported by interlayer 13. As a result of this, a planar layer of ink equal in size to that of pixel x in the recorded region forms on recording paper s.

Figure 4:
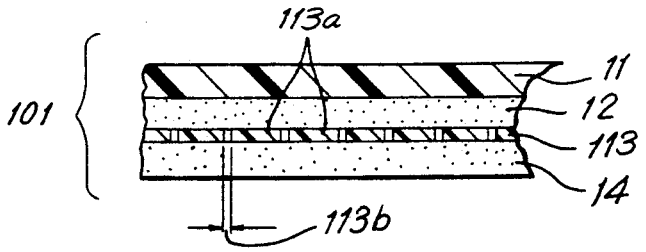
FIG. 4 is a sectional view of a thermal transfer ink sheet constructed in accordance with an embodiment of the invention in which the interlayer is composed of separate domains of thermoplastic material.
Figure 5:
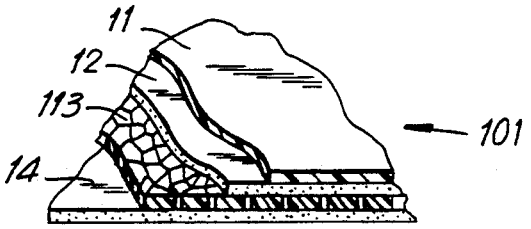
FIG. 5 is a perspective view of the thermal transfer ink sheet of FIG. 4.

A third embodiment of an ink sheet in accordance with the invention is illustrated in FIGS. 4 and 5 as ink sheet 101. Ink sheet 101 is similar to ink sheet 10 described above and includes first ink layer 12 and second ink layer 14 formed of the same materials described above. An interlayer 113 is also formed of thermoplastic resins with low melting points. However, rather than being a uniform layer as interlayer 13, interlayer 113 includes minute domains 113*a* of thermoplastic resin separated by gaps.

In the embodiment shown in FIG. 4, domains 113*a* are separated by gaps 113*b* running perpendicular to the surfaces of ink sheet 101. The thermoplastic resin may include crosslinking organic material as the main component. Alternatively, the waxes and polymers which are used in first ink layer 12 can be used. However, up to about 50 wt % wax should be included to minimize the change in viscosity with change in temperature. It is also desirable to add inorganic or thermosetting additives, such as titanium oxide, calcium carbonate or carbon black. As in the case of the earlier described embodiments, interlayer 113 prevents ink in the recorded portion of first ink layer 12 from flowing during heating. Interlayer 113 maintains the thickness of first ink layer 12 uniform in the recorded portion after separation from the non-recorded portion.

Minute domains 13*a* in interlayer 13 are formed by cracking a film formed on first ink layer 12 by one of the following methods:

1. Mesh printing (gravure printing) a film;
2. Depositing a material with a high coefficient of thermal expansion for interlayer 13 by the solvent-hot melt method and then drying and cooling; or
3. Coating an emulsion on first ink layer 12 and drying at a temperature lower than the lowest temperature at which a film can be formed.

The size of domains 113*a* should be smaller than the diameter of a transferred dot or pixel x. The maximum diameter of domain 113*a* should be about 200 μm. Because first ink layer 12 melts during printing, it should be prevented from flowing through gaps 113*b* onto recording paper s. Therefore, gap 113*b* should be less than about 50 μm which insures that interlayer 113 will be present between the ink layers in the recorded portion. To improve the sharpness of each pixel, gap 113*b* should be reduced. However, the minimum size of gap 113*b* is about 0.1 μm. Interlayer 113 should have a minimum thickness of about 0.1 μm to prevent first ink layer 12 from flowing during heating. Interlayer 113 should be thinner than about 5 μm to prevent reduction in printing speed.

As described above, the recorded portion of interlayer 113 must maintain a uniform layer shape. During printing with ink sheet 101, some melted ink flows into gaps 113*b*. Additionally, each domain 113*a* is softened and expands. As a result, the heated portion of interlayer 113 forms a continuous film structure 113*c* shown in FIG. 6B. Film 113*c* supports the recorded portion of first ink layer 12 and second ink layer 14.

Figure 6A:
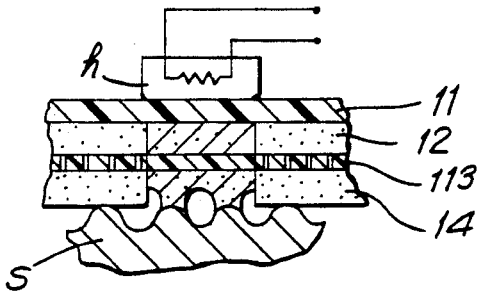
FIGS. 6A and 6B are sectional views of thermal transfer printing using the thermal transfer ink sheet of FIG. 4.
Figure 6B:
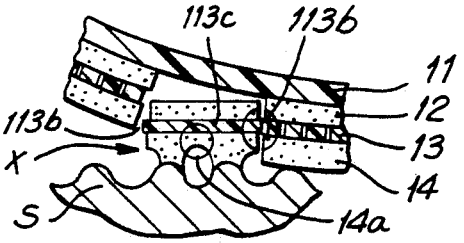

After the heating of ink sheet 101, as shown in FIG. 6A, support film 11 is stripped away from recording paper s, as shown in FIG. 6B. The recording portion of interlayer 113 separates from the non-heated portion along domain gaps 13*b*. Ink in first ink layer 12 separates from the non-recorded portion. Thus, ink supported by interlayer 113 is transferred onto recording paper s while maintaining uniform thickness. In this manner, recorded ink portion 14*a* of second ink layer 14 becomes thin in the non-conducting region due to flowing towards convex hills d of recording paper s but is supported by interlayer 113. This results in forming pixel x with a uniform visible ink layer 12 because first ink layer 12 is supported by interlayer 113 as a uniform layer.

Figure 7A:
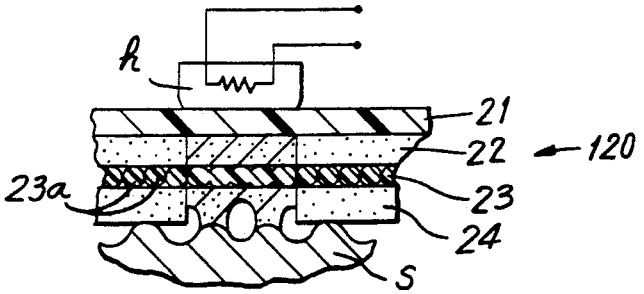
FIGS. 7A and 7B are sectional views illustrating thermal transfer printing using a thermal transfer ink sheet constructed in accordance with another embodiment of the invention.
Figure 7B:
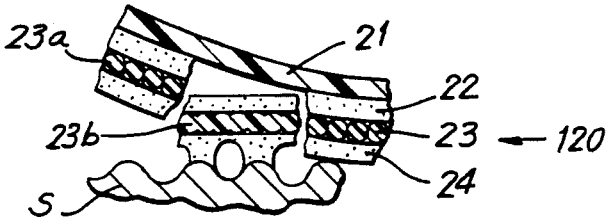
Figure 8A:
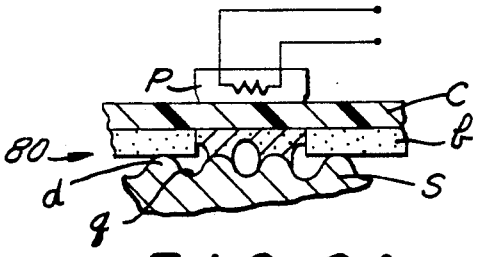
FIG. 8A PRIOR ART
FIGS. 8A and 8B are sectional views illustrating thermal transfer printing with a conventional thermal transfer ink sheet.
Figure 8B:
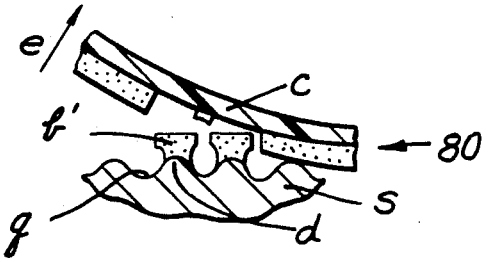
FIG. 8B PRIOR ART

An ink sheet 120 constructed in accordance with another embodiment of the invention is shown in FIGS. 7A and 7B. Ink sheet 120 includes an interlayer 23 formed of minute grains 23*a*. Minute grains 23*a* can be made from the thermoplastic resins or the cross-linking type organic materials discussed in connection with the previous embodiment. Grains 23*a* are disposed in a layer between a first ink layer 22 and a second ink layer 24 and have a diameter less than the diameter of a pixel.

Grains 23*a* can be made by the following methods. Thermoplastic materials are melted and kneaded by heating, set by cooling, and finely divided with a grinder, such as a jetmill. Alternatively, insoluble thermoplastic material in an aqueous or non-aqueous solvent are emulsified and coated on first ink layer 22 followed by drying at a temperature below the lowest film forming temperature which results in an aggregation of grains.

To support first ink layer 22 in a uniform layer during printing, grains 23*a* are heated by thermal head h and fuse to form a layer 23*b*. Layer 23*b* supports first ink layer 22 and second ink layer 24 in the recorded portion of pixel x. Pixel x of second ink layer 24, interlayer 23*b* and first ink layer 22 remain on recording paper s after support film 21 is stripped away, as shown in FIG. 7B, in a similar manner as described above.

The invention will now be explained in detail with reference to the following Examples. These Examples are presented for purposes of illustration only and are not intended to be construed in a limiting sense.

EXAMPLE 1

A four layer thermal transfer ink sheet including a 4 μm thick PET heat resistant support film was prepared. A first ink layer 3 μm thick having a melting point of 70° was coated onto the support film by the hot melt method. The first ink layer included 40 wt % paraffin wax, 30 wt % microcrystalline wax, 10 wt % polyethylene, 5 wt % EEA, 5 wt % EVA and 10 wt % carbon black. An interlayer was formed on first ink layer by dissolving polyester resin in a toluene, methyl-ethyl ketone solvent with 30 wt % solid titanium oxide and dried to a 0.5 μm thick layer by the solvent-gravure method. A second ink layer was formed on the surface of interlayer using the hot melt-solvent method. This second ink layer of 50 wt % paraffin wax, 25 wt % carnauba wax, 10 wt % polyethylene and 15 wt % EVA had a melting point of 65° C. and was coated to 4 μm thick.

This ink sheet was used to print one hundred dots onto a recording paper with a Beck's resolution of 2 seconds using a thermal printing head having a resolution of 180 dots per inch. In order to compare the quality of this printing with the quality of printing from a conventional ink transfer sheet, one hundred dots were printed using the same print head. The conventional ink sheet was based on the same heat resistant support film coated with a 6 μm layer of the same ink composition. The results from this comparison are summarized in Table 1.

As shown by the results in Table 1, the thermal ink transfer sheets constructed in accordance with the invention exhibited superior printing qualities compared to conventional ink transfer sheets. The pixels printed by the ink sheet including the interlayer and second ink layer were uniform in shape. The conventional ink sheet printed pixels with substantial variations in area. The ink sheet constructed in accordance with the invention also produced twice the optical density of the conventional ink sheet, but used the safe or less thermal energy.

Print quality was measured by comparing the area of the print head with the area of a single printed dot. The standard deviation of these values is presented in Table 1. Printing density (O.D.) was measured when solid print was carried out. To compare print energy, the energy to provide the highest density when the conventional ink sheet is used was assigned a value of 1. The print energy of the Example was then compared to the print energy of the conventional ink sheet. The ink transfer sheet of the Example provided superior performance compared to the conventional sheet in every category.

EXAMPLE 2

The same heat resistant support film of Example 1 was coated with a 2 μm thick first ink layer having a melting point of 85° C. The first ink layer included 60 wt % paraffin wax, 20 wt % maleic anhydric copolymer, 5 wt % vinyl acetate, 5 wt % EEA and 10 wt % carbon black. A 0.2 μm thick interlayer was formed on the exposed surface of the first ink layer by coating the first ink layer with a solvent of phenoxy and toluene-methyl-ethyl-ketone-MIKB mixing solvent with isocyanate as a cross-link agent and 25 wt % carbon black solid. The solvent was coated on the exposed surface of first ink layer and cured at a temperature of 50° C. for 24 hours after drying. A 5 μm thick second ink layer having a melting point of 55° C. was applied to interlayer by the hot melt method. This second ink layer included 35 wt % carnauba wax, 30 wt % polyethylene, 20 wt % EEA and 15 wt % carbon black.

This ink transfer sheet was also tested and outperformed the conventional transfer film. The results are summarized in Table 1.

EXAMPLE 3

A 3 μm thick PET film was used as the heat resistant support film and a 5 μm thick first ink layer having a melting point of 45° C. of 30 wt % microcrystalline wax, 25 wt % deforming wax polar wax), 25 wt % polyvinyl alcohol, 15 wt % EDA and 10 wt % carbon black was coated thereon. A 1 μm thick interlayer formed from an acryl emulsion was coated on first ink layer. The interlayer had a softening point at about 80° C. A 3 μm thick second ink layer having a melting point of 70° C. was coated on the exposed surface of the interlayer. The second ink layer included 20 wt % paraffin wax, 50 wt % maleic anhydric copolymer, 10 wt % polyethylene, 10 wt % EEA and 10 wt % EVA.

The ink sheet of Example 3 was tested as in Example 1 and the results are also summarized in Table 1.

TABLE 1

| Example | 1 | 2 | 3 | Conventional |
|---|---|---|---|---|
| Standard deviation of dot area variability | 0.06 | 0.05 | 0.07 | 0.28 |
| O.D. of solid print | 1.5 | 1.8 | 1.8 | 0.6 |
| Printing energy relative to maximum density conventional printing energy | 0.9 | 0.8 | 1.0 | 1 |

EXAMPLE 4

An ink sheet was formed in the same manner as Example 1, except with a different interlayer. A silicon-acryl emulsion (diameter of 0.5 μm, aqueous) with a lowest film forming temperature of 90° C. was coated on first ink layer at room temperature and dried at a temperature of 50° C. to form an interlayer with domain diameters of 7 μm, domain gaps of 0.5 μm and a dry film thickness of 1.5 μm. The second ink layer was formed on first ink layer. Transfer printing with this embodiment was tested the same way as Example 1 and the results are summarized in Table 2.

EXAMPLE 5

An ink sheet was formed in the same manner as Example 2, except with a different interlayer. A styrene-acryl copolymer emulsion (diameter of 0.1 μm) with a lowest film forming temperature of 100° C. was coated on the first ink layer at room temperature and dried at a temperature of 60° C. to form an interlayer with domain diameters of 5 μm, domain gaps of 0.3 μm and a dry film thickness of 0.5 μm was coated on first ink layer.

Transfer printing was tested as in Example 1 and the results are summarized in Table 2.

EXAMPLE 6

An ink sheet was formed in the same manner as Example 3, except with a different interlayer. An acrylic acid ester emulsion (diameter of 0.3 μm) with a lowest film forming temperature of 80° C. was coated on the first ink layer at room temperature and dried at a temperature of 50° C. to form an interlayer with domain diameters of 10 μm, domain gaps of 1 μm and a dried film thickness of 1.2 μm.

Transfer printing was tested and the results are summarized in Table 2.

The ink sheets formed in accordance with the invention and tested in Examples 4 to 6 exhibited superior printing properties than the conventional ink sheets. Pixels had insubstantial variation in area and over twice the optical density. These superior results were accomplished with slightly lower printing energy.

TABLE 2

| Example | 4 | 5 | 6 | Conventional |
|---|---|---|---|---|
| Standard deviation of dot area variability | 0.03 | 0.02 | 0.04 | 0.28 |
| O.D. of solid print | 1.5 | 1.8 | 1.8 | 0.6 |
| Printing energy relative to maximum density printing energy | 0.9 | 0.8 | 0.9 | 1 |

In accordance with the invention, thermal transfer printing is accomplished using a thermal transfer sheet having two ink layers and an interlayer therebetween formed on a heat resistant support film. Each ink layer is laminated to a different side of the interlayer. The transfer recording process in accordance with the invention includes selectively applying thermal energy to the exposed surface of the support film to melt adjacent portions of the ink layer and subsequent exfoliation of the heat resistant support film. The visible surface of the ink applied during the printing process is maintained in a uniform layer condition. Thus, a uniform smooth printed surface can be attained on a rough recording medium. Images of high resolution and density can be achieved without variability in the pixels applied. Additionally, inks with low melting points can be used to reduce the thermal energy required for printing.

Accordingly, if the interlayer is formed of a thin film of thermosetting material, the interlayer and ink layers separate easily from the non-recorded portion due to the weakness in integrity of the interlayer. This enables obtaining beautiful images without variations in dot density.

When interlayer is a thermoplastic material having a grain or domain size smaller than a pixel and thermoplastic material is in the first ink layer, during printing a small quantity of ink flows into the gaps between the domains and the printed portion of the interlayer softens and expands and forms a pixel sized integral support layer. Thus, interlayer can be transferred onto the recording medium and maintain the melted ink of first ink layer in a layered condition. Even if recording medium has poor surface quality, ink can be transferred in a uniform manner and images of high quality and density can be formed. In addition, the interlayer in the recorded portion separates cleanly and sharply from the non-recorded portion. Ink in the recorded portion adheres to interlayer as a single body. Thus, clean images without variation of transferred dots can be formed.

It will thus be seen that the objects set forth above, among those made apparent from the preceding description, are efficiently attained and, since certain changes may be made in carrying out the above method and in the articles set forth without departing from the spirit and scope of the invention, it is intended that all matter contained in the above description and shown in the accompanying drawings shall be interpreted as illustrative and not in a limiting sense.

It is also understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

What is claimed is:

1. A thermal transfer ink sheet for thermal printing, comprising:

a heat resistant support layer;

a fusible first ink layer including a colorant disposed on the support layer;

an interlayer disposed on the first ink layer, the interlayer including a material selected from the group consisting of resins, waxes and mixtures thereof and formulated so that the cohesive properties of selected portions of the interlayer are increased when heated during thermal printing, so that the interlayer will support the first ink layer in a substantially uniform manner when transferred to a recording medium during thermal printing; and a second fusible layer disposed on the interlayer, the materials for the first fusible ink layer, interlayer and second fusible layer selected so that the second fusible layer, interlayer and first ink layer are transferred together to and adhere to a recording medium as a single body to form a dot of ink during thermal printing.

2. The thermal transfer ink sheet of claim 1, wherein the second fusible layer is an ink layer including a colorant.

3. The thermal transfer ink sheet of claim 2, wherein the second fusible layer includes at least about 40% by weight max.

4. The thermal transfer ink sheet of claim 3, wherein the second fusible layer includes at least one wax selected from the group consisting of natural wax, synthetic wax and mixtures thereof and at least one organic additive selected from the group consisting of fatty amides, fatty esters, methyl cellulose, carboxyl methyl cellulose, styrene-butadiene copolymers, methylmethacrylate resins, silicone resins, polyethylene, styrene-acryl copolymers, acrylic resins, polystyrene and mixtures thereof.

5. The thermal transfer ink sheet of claim 2, wherein the second fusible layer has a melting point between about 50° and 150° C.

6. The thermal transfer ink sheet of claim 1, wherein the interlayer is formed of a material in which viscosity does not vary substantially with temperature within the temperature range encountered during thermal printing.

7. The thermal transfer ink sheet of claim 1, wherein the interlayer is a thin film of thermoplastic resin.

8. The thermal transfer ink sheet of claim 7, wherein the thin film thermoplastic resin is between about 0.1 to 5 μm thick.

9. The thermal transfer ink sheet of claim 8, wherein the interlayer includes wax in an amount less than about 50% by weight.

10. The thermal transfer ink sheet of claim 9, wherein the thermoplastic material of the interlayer further includes an inorganic additive selected from the group consisting of titanium oxide, calcium carbonate, carbon black and mixtures thereof.

11. The thermal transfer ink sheet of claim 7, wherein the thermoplastic resin is selected from the group consisting of phenol resins, melanin resins, urea resins, unsaturated polyester resins, epoxy resins, polyamides, silicone resins, alkyd resins, urethane resins, casein resins and mixtures thereof.

12. The thermal transfer ink sheet of claim 4. wherein the interlayer includes wax in an amount less than 50% by weight.

13. The thermal transfer ink sheet of claim 1, wherein the interlayer is formed from thermosetting resin.

14. The thermal transfer ink sheet of claim 1, wherein the first ink layer includes at least about 50% by weight wax.

15. The thermal transfer ink sheet of claim 14, wherein the first ink layer includes at least one wax selected from the group consisting of natural wax, synthetic wax and mixtures thereof and at least one organic additive selected from the group consisting of fatty amides, fatty esters, methyl cellulose, carboxyl methyl cellulose, styrene-butadiene copolymers, methyl-methacrylate resins, silicone resins, polyethylene, styrene-acryl copolymers, acrylic resins, polystyrene and mixtures thereof.

16. The thermal transfer ink sheet of claim 1, wherein said first ink layer has a melting point between about 40° to 200° C.

17. The thermal transfer ink sheet of claim 1, wherein the support layer is formed of a material selected from a group consisting of condenser paper, polyethylene terephthalate, polyether sulfone, polyetherether ketone, polyphenylene sulfide polyimide, polyamideimide and polycarbonate.

18. The thermal transfer ink sheet of claim 1, wherein the interlayer is formed from at least one member selected from the group consisting of silicone-acryl emulsions, styrene-acryl copolymer emulsions and acrylic acid ester emulsions.

19. The thermal transfer ink sheet of claim 1, wherein the interlayer is formed with acryl-emulsions.

20. A thermal transfer ink sheet, comprising:

a heat resistant support layer;

a first fusible ink layer including a colorant disposed on the support layer;

an interlayer disposed on the first ink layer for supporting the first ink layer in a substantially uniform manner when transferred to a recording medium during thermal printing, the interlayer being a thin layer including at least one of thermoplastic resins and thermosetting resins in the form of discrete domains separated by gaps extending through the thickness of the interlayer, the domains having a particle size smaller than about 200 μm in diameter; and a second fusible layer disposed on the interlayer, the materials for the first fusible ink layer, interlayer and second fusible layer selected so that the second fusible layer, interlayer and first ink layer are transferred to and adhere to a recording medium as a single body to form a dot of ink during thermal printing.

21. The thermal transfer ink sheet of claim 20, wherein the gaps are between about 0.1 and 50 μm wide.

22. The thermal transfer ink sheet of claim 20, wherein the interlayer further includes an inorganic additive selected from the group consisting of calcium carbonate, titanium oxide, carbon black and mixtures thereof.

23. The thermal transfer ink sheet of claim 20, wherein the interlayer includes wax in an amount less than about 50% by weight.

24. The thermal transfer ink sheet of claim 23, wherein the thermoplastic material of the interlayer further includes an inorganic additive selected from the group consisting of titanium oxide, calcium carbonate, carbon black and mixtures thereof.

25. The thermal transfer ink sheet of claim 20, wherein the second fusible layer is an ink layer including a colorant.

26. A thermal transfer ink sheet, comprising:

a heat resistant support layer;

a first fusible ink layer including a colorant disposed on the support layer;

an interlayer disposed on the first ink layer for supporting the first ink layer in a substantially uniform manner when transferred to a recording medium during thermal printing, the interlayer being a thin film of a thermosetting material; and a second fusible layer disposed on the interlayer, whereby the second fusible layer, interlayer and first ink layer are transferred to and adhere to a recording medium as a single body to form a dot of ink during thermal printing.

27. The thermal transfer ink sheet of claim 26, wherein the second fusible layer is an ink layer including a colorant.

28. A thermal transfer ink sheet, comprising:

a heat resistant support layer;

a first fusible ink layer including a colorant disposed on the support layer;

an interlayer disposed on the first ink layer for supporting the first ink layer in a substantially uniform manner when transferred to a recording medium during thermal printing, the interlayer being a thin layer formed from at least one of a thermoplastic resin and a thermosetting resin, on the first layer in the form of fine grains having a particle size smaller than about 200 μm in diameter and formulated so that the cohesive properties of selected portions of the interlayer increase after the selected portions are heated during thermal printing;

a second fusible layer disposed on the interlayer, the materials for the first fusible ink layer, interlayer and second fusible layer selected so that the second fusible layer, interlayer and first ink layer are transferred to and a adhere to a recording medium as a single body to form a dot of ink during thermal printing.

29. The thermal transfer ink sheet of claim 28, wherein the second fusible layer is an ink layer including a colorant.

30. A method for preparing a thermal transfer ink sheet for thermal transfer printing, comprising:

providing a heat resistant support layer;

applying a first fusible ink layer to one surface of the support layer;

applying an interlayer on the first ink layer, the interlayer including materials whose cohesive properties will increase after the interlayer is heated during thermal printing to maintain the first ink layer in a substantially uniform manner when it is transferred to a recording medium during thermal transfer printing; and applying a second fusible layer to the interlayer.

31. The method of claim 30, including forming the interlayer into separate domains separated by gaps which extend continuously from the first ink layer to the second fusible layer.

32. The method of claim 31, wherein the domains are formed by gravure printing.

33. The method of claim 31, including forming the gaps between domains by coating with a material having a large coefficient of thermal expansion by the solvent hot melt method drying and cooling.

34. The method of claim 31, including forming the gaps between domains by coating an emulsion, and drying the coated emulsion at a temperature below the lowest temperature at which a film will form.

35. The method of claim 30, including applying the interlayer as an aggregation of grains, the grains formed by melting thermoplastic material, kneading the thermoplastic material by heating and cooling to set and grinding the thermoplastic material into finely divided grains.

36. The method for manufacturing a thermal transfer ink sheet of claim 30, wherein the interlayer is applied to the first ink layer by forming an emulsion including material selected from the group consisting of thermoplastic resins, thermosetting resins and mixtures thereof, then coating the first ink layer with the emulsion, and drying the emulsion at a temperature below the lowest film forming temperature of that emulsion.

37. A method of thermal transfer printing an image on a recording medium using a thermal transfer ink sheet having a support layer, a first fusible ink layer including colorant on the support film, an interlayer including one of thermosetting resins and thermoplastic resins, the cohesion of which will increase during thermal printing to maintain the first ink layer in a substantially uniform manner during thermal printing on the first ink layer and a second fusible layer on the interlayer, comprising:

positioning the ink sheet against the recording medium so that the second ink layer contacts the recording medium;

selectively applying thermal energy to the support layer in accordance with image signals corresponding to the image sought to the printed to heat selected portions of the first ink layer, second fusible layer and interlayer, increasing the cohesion of the selected portions of the interlayer and causing the selected portions of the first ink layer and second fusible layer to substantially soften and adhering the selected portions of the first ink layer, interlayer and second fusible layer to the recording medium as a single body to form a dot of ink on the recording medium, the interlayer maintaining the first ink layer in a substantially uniform manner; and separating the selected portion including the first ink layer, interlayer and second fusible layer from the non-printed portion.

* * * * *